United States Patent [19]

Skinner

[11] 4,019,835

[45] Apr. 26, 1977

[54] LIQUID FUEL INJECTION PUMPING APPARATUS

[75] Inventor: Robert Thomas John Skinner, High Wycombe, England

[73] Assignee: C.A.V. Limited, Birmingham, England

[22] Filed: July 17, 1975

[21] Appl. No.: 596,894

[30] Foreign Application Priority Data

July 19, 1974 United Kingdom ..... 32018/74

[52] U.S. Cl. ..... 417/253; 123/139 AQ; 417/462

[51] Int. Cl.[2] ..... F04B 3/00

[58] Field of Search ..... 417/462, 244, 245, 254, 417/219, 221, 282, 294, 253; 123/139 AM, 139 AQ, 139 R, 140 MC

[56] References Cited

UNITED STATES PATENTS

| | | | |
|---|---|---|---|
| 2,669,094 | 2/1954 | Lee | 417/294 X |
| 3,394,688 | 7/1968 | Roosa | 123/139 AQ |
| 3,536,421 | 10/1970 | Kemp | 417/294 X |
| 3,861,833 | 1/1975 | Salzgeber et al. | 417/462 X |
| 3,861,835 | 1/1975 | Bakti | 417/462 |
| 3,897,764 | 8/1975 | Bakti | 123/139 AM |

*Primary Examiner*—William L. Freeh
*Assistant Examiner*—Edward Look

[57] ABSTRACT

A liquid fuel injection pumping apparatus includes an injection pump to which fuel is supplied by a feed pump by way of a throttle which includes an axially movable member. The pressure of fuel upstream of the throttle is controlled by a valve so that its pressure varies in accordance with the law $RN^2$. The apparatus also includes a further valve which provides a substantially constant pressure and this pressure is applied to a piston by way of a further orifice the size of which depends upon the setting of the throttle. The further piston influences the timing of injection of fuel by the apparatus and in addition a pressure which is proportional to the square of the speed at which the apparatus is driven, is generated and is also used to influence the timing of delivery of fuel.

15 Claims, 4 Drawing Figures

LIQUID FUEL INJECTION PUMPING APPARATUS

This invention relates to liquid fuel injection pumping apparatus for supplying fuel to internal combustion engines, and of the kind comprising an injection pump adapted to be driven in timed relationship with an engine with which the apparatus is associated, a feed pump for supplying fuel under pressure, a movable throttle member located within a body, the throttle member and body defining an adjustable orifice through which fuel can flow for supply to the injection pump, and a fluid pressure operable means movable to adjust the timing of delivery of fuel by the injection pump.

The object of the invention is to provide such an apparatus in a simple and convenient form.

According to the invention, an apparatus of the kind specified comprises first valve means operable to provide a first pressure which varies as the square of the speed at which the apparatus is driven, said first pressure being applied to said fluid pressure operable means whereby the timing of delivery of fuel is responsive to the speed at which the apparatus is driven, second valve means for providing a second pressure which varies in accordance with the law $RN^2$ where R is a constant and N the speed at which the apparatus is driven, fuel at said second pressure being supplied to the injection pump through said adjustable orifice, a third valve for providing a third pressure having a substantially constant value, and a further adjustable orifice defined by the throttle member and body, and which is utilised to derive a control pressure from said third pressure, and a piston which can be subjected to said control pressure, said piston acting to control the force exerted on said fluid pressure operable means by resilient means acting in opposition to said first pressure.

One example of an apparatus in accordance with the invention will now be described with reference to the accompanying drawings, in which.

Figure 1:
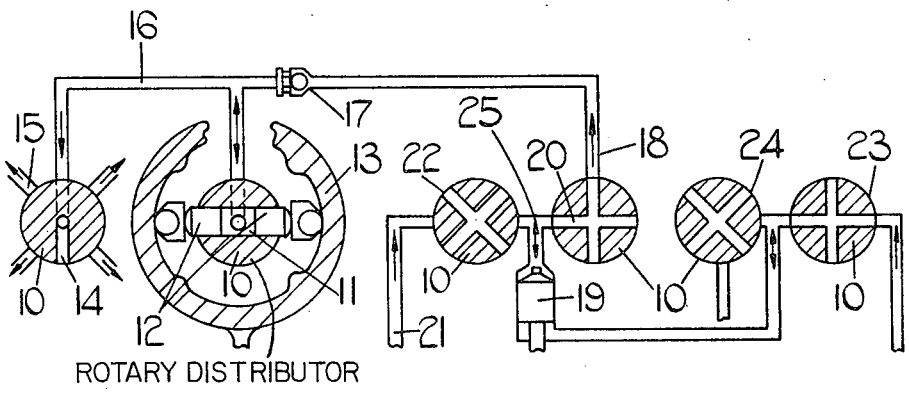
FIG. 1 is a diagrammatic illustration of part of the apparatus.

Referring to FIG. 1 of the drawings, there is provided a distributor member 10 which is mounted in a body part not shown, the distributor member 10 for convenience, is shown in six separate sections in FIG. 1, and formed in the distributor member is a transversely extending passage 11 in which are mounted a pair of reciprocable plungers 12 which are adapted to be moved inwardly as the distributor member rotates, by a plurality of pairs of cam lobes formed on the internal periphery of an annular cam ring 13. The cam lobes, plungers and the passage 11 constitute an injection pump. Formed within the distributor member is a passage 16, which communicates with a radially extending passage 14 also formed in the distributor member. The passage 14 is adapted to register in turn and during successive injection strokes of the injection pump, with a plurality of outlet ports 15 formed in the body part and connected respectively to fuel injection nozzles associated with the combustion chambers of the associated engine.

A passage 18 is also formed in the distributor member and communicates with the passage 16 by way of a non-return valve 17. The passage 18 communicates with a plurality of equiangularly spaced inlet passages 20 which can register in turn and during the filling strokes of the injection pump, with an inlet port 25 which communicates with one end of a cylinder containing a movable shuttle 19. When fuel is supplied to the other end of the cylinder containing the shuttle 19, fuel is displaced to the port 25 and flows by way of a passage 20 to the injection pump. As the injection pump partakes of an injection stroke, a fresh supply of fuel is supplied through a passage 21 formed in the body part, and this flows through passages 22 formed in the distributor member, to the port 25. The shuttle 19 is therefore moved in the opposite direction by an amount dependent upon the quantity of fuel supplied by way of the passage 21. As the shuttle 19 is moving from said one end of the cylinder, fuel in the other end of the cylinder is allowed to escape to a drain by way of a valve means 24 and a further valve means 23 is provided through which fuel can be supplied to the end of the cylinder remote from the port 25 when it is required to displace fuel to the injection pump. The valve means 23 communicates with the outlet of a feed pump 26 which is seen in FIG. 2.

The feed pump 26 includes a rotary part which is conveniently formed as part of the distributor member 10. The outlet 27 of the feed pump and the inlet 28 are interconnected by means of a relief valve 29 which controls the output pressure of the feed pump in a manner so that in practice, it increases as the speed at which the apparatus is driven increases.

Figure 2:
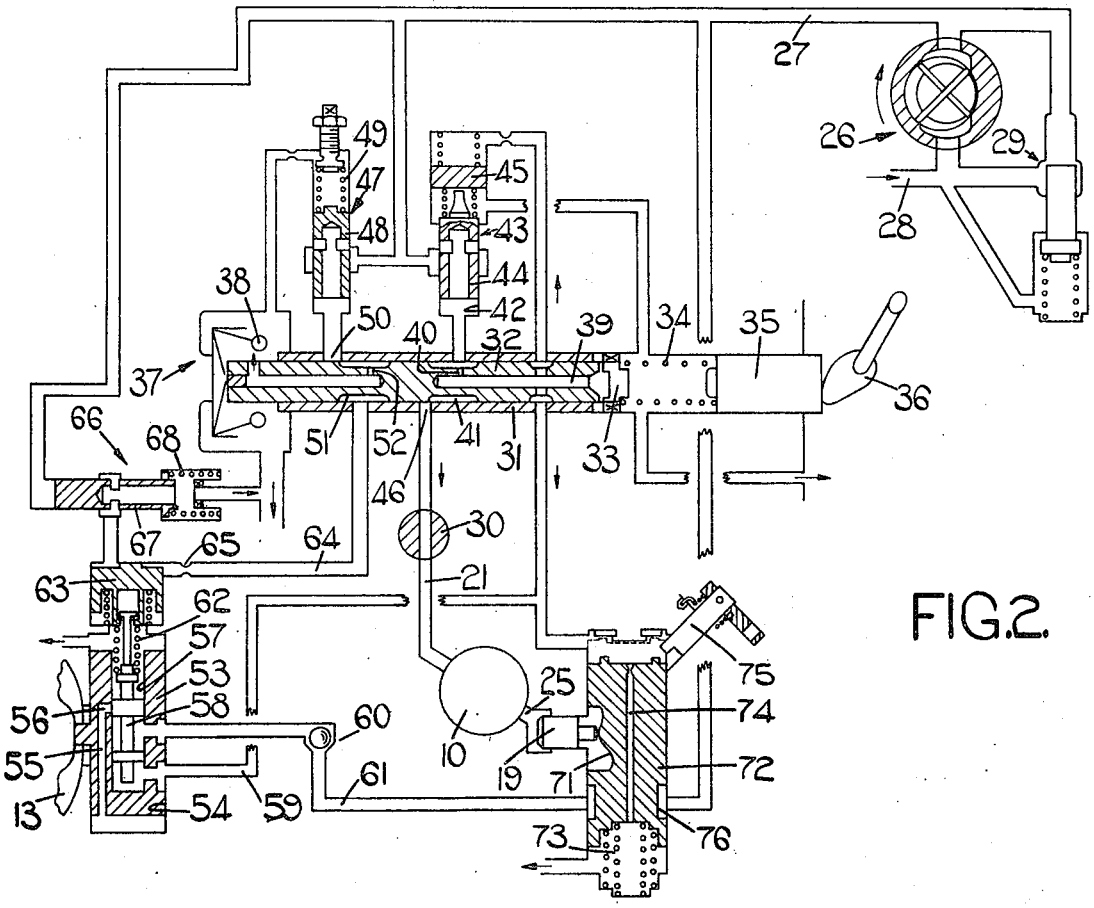
FIG. 2 is a diagrammatic illustration of the remaining portion of the apparatus.

As seen in FIG. 2, the passage 21 includes a shut-off valve 30 whereby the supply of fuel to the injection pump can be halted when it is required to stop the engine.

Also provided in the body part is a sleeve 31 in which is mounted an axially movable rod member 32. At one end of the rod member, there is disposed a valve closure member 33 which constitutes part of a first valve means. The closure member is biased against the rod member by means of a coiled compression spring 34 and the force exerted by this spring can be varied by movement of an abutment 35 by means of an operator adjustable member 36. Acting upon the opposite end of the rod member 32 is a centrifugal weight assembly 37, which includes weights 38 located within a cage. The cage is driven conveniently by means of gearing, from the distributor member so that the cage rotates at a speed which is proportional to the speed of operation of the associated engine. Moreover, the weights, as they move outwardly, effect axial movement of the rod member 32 against the action of the spring 34.

Formed within the rod member is a blind bore 39, the open end of which is closed by the closure member 33. Moreover, the bore 39 communicates by way of a restricted orifice 40, with a circumferential groove 41 formed in the rod member. The groove 41 is in constant communication with one end of a cylinder 42 forming part of a second valve means 43. Within the cylinder 42 is an axially movable valve element 44, within which is formed a blind bore which opens into ports in the periphery of the element. The ports can register with a groove formed in the wall of the cylinder and which is in constant communication with the outlet 27 of the feed pump. The valve element 44 is acted upon by a piston 45 which is subjected to the pressure within the bore 39, and the area of the piston 45 is larger than that of the valve member 44. The pressure within the bore 39 varies as the square of the speed, since the closure member 33 is urged to close the end of the passage 39 by a force which varies as the square of the speed, the effect of this is that the pressure within the circumferential groove 41 will vary in accordance with the law $RN^2$ where R is a constant depending upon the ratio of the areas of the piston 45 and the valve element 44. Formed in the sleeve 31 is a port 46 which can register with the groove 41 and defines therewith an adjustable orifice through which fuel is supplied to the passage 21. The size of the orifice depends upon the setting of the abutment 35, and in this manner the amount of fuel which is supplied to the engine, is adjustable. The axial setting of the rod member 32 provides an indication of the load on the engine.

A third valve means 47 is provided, and this includes a movable valve element 48 which again is provided with a blind bore communicating with ports on the exterior of the element, the ports being arranged to register with a circumferential groove formed in the cylinder accommodating the element, the groove being in constant communication with the outlet 27 of the feed pump. The valve element 48 is biassed by a coiled compression spring 49, and the end of the cylinder containing the element communicates with a port 50 formed in the aforesaid sleeve. The effect of the valve 47 is to produce a substantially constant pressure from the fluctuating outlet pressure of the feed pump. It will be noted that the portion of the cylinder containing the valve element 48 and which contains the spring 49, communicates with a drain and a damping restrictor is located within the passage communicating with the drain. A similar damping restrictor is provided for the valve 43.

Formed on the periphery of the rod member is a further circumferential groove 51, and this communicates with a drain by way of a fixed orifice 52. The circumferential groove 51, and the port 50 constitute an adjustable orifice, the size of which depends upon the axial setting of the rod member 32. There is thus obtained in the circumferential groove 51, a pressure termed a control pressure, the magnitude of which is indicative of the load on the associated engine.

The cam ring 13 is angularly adjustable to enable the timing of delivery of fuel by the injection pump constituted by the plungers 12, to be varied. For this purpose, there is provided a fluid pressure operable piston 53 which is coupled to the cam ring 13. The piston 53 is located within a cylinder 54 one end of which is in communication with the drain, whilst the other end of the cylinder can be supplied with fuel under pressure by way of a passage 55 formed in the piston 53. The passage 55 communicates with a port 56 opening into a cylinder 57 which is formed in the piston 53. The cylinder 57 contains a landed valve element 58, one end of which is subjected to the pressure of fuel in the bore 39. This pressure of course varies in accordance with the square of the speed at which the apparatus is driven, and the fluid pressure is conveyed by way of a passage 59. The valve element 58 has a pair of lands, one of which is arranged to cover the port 56 and the space intermediate the lands communicates with the outlet 27 of the feed pump by way of an anti-shock valve 60 contained within a passage 61. As the valve element 58 is moved upwardly as seen in FIG. 2, the port 56 will be exposed to the pressure in the passage 61, and fuel at this pressure will therefore flow through the passage 55 into the closed end of the cylinder 54. As a result, the piston 53 will move upwardly, the piston and value element 58 therefore constituting a follow-up servo system. As the piston moves upwardly, the timing of delivery of fuel to the engine is advanced. If however, the valve element 58 moves downwardly, then the port 56 will be exposed to a drain, and fuel can therefore escape from the closed end of the cylinder 54 so that the timing of injection is retarded.

The valve element 58 is subjected to the force exerted by a coiled compression spring 62, one end of which engages the valve element 58, whilst the other end engages a piston 63 which is itself spring loaded. A link is provided between the piston 63 and the valve element 58 to limit the degree of extension of the spring 62. At its end remote from the valve element 58, the piston 63 can be subjected by way of a passage 64, to the aforesaid control pressure within the circumferential groove 51, and a restrictor 65 is disposed in the passage 64. Movement of the piston 63 under the action of the control pressure, will therefore increase the force exerted by the spring 62 on the valve element 58 thus the setting of the piston 53, will be dependent upon the speed of the associated engine, and also the load on the associated engine.

Figure 3:
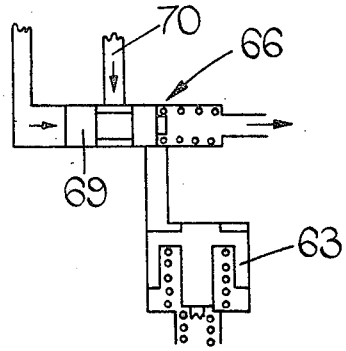
FIG. 3 shows an alternative arrangement to a portion of the apparatus seen in FIG. 2

In some circumstances, it is desirable that at low speeds the timing of delivery of fuel should be advanced, and for this purpose the control pressure applied to the piston 63 is reduced practically to zero. This is achieved by means of a valve 66 including a valve element 67 which is subject to the outlet pressure of the feed pump, and which is moved in opposition to this pressure by means of a spring 68. The arrangement of the valve is such that at low speeds, the valve is open and thereby by virtue of the restrictor 65, the pressure applied to the piston 63 is practically zero. As the speed at which the apparatus is driven increases, then the valve element 67 will be moved against the action of its spring to effect closure of the valve so that the aforesaid control pressure is applied to the piston 63. An alternative arrangement of the valve 66 is seen in FIG. 3, and in this case a spool valve 69 is utilised which has a groove communicating with the circumferential groove 51 by way of a passage 70. The spool valve is spring loaded against the action of the pressure at the outlet 27 of the feed pump, and when this pressure attains a predetermined value, the spool valve moves against the action of its spring to place the passage 70 in communication with the cylinder containing the piston 63. It will be noted that in this example, there is no restricted orifice 65. However, the spool valve does place the end of the cylinder containing the piston 63 in communication with the drain so that the piston 63 can return to the position in which it is shown in FIG. 2, under the action of its spring.

Referring again to FIG. 2, it will be seen that the maximum movement of the shuttle 19 due to fuel flowing through the port 25, is limited by an adjustable stop constituted by a shaped surface 71 formed on a fluid pressure operable piston 72. The piston 72 is resiliently loaded by a pair of coiled compression springs 73, and is movable against the action of the springs by fuel under pressure obtained from the first valve means, that is to say, fuel the pressure of which varies in accordance with the square of the speed at which the apparatus is driven. Conveniently, the piston 72 has a through passage 74 which contains a restrictor. Moreover, the contoured surface 71 is shaped so that the shuttle 19 can move a greater than normal extent so as to enable an excess of fuel to be supplied to the engine, for starting purposes. A manually operable stop member 75 is provided which in normal circumstances limits the movement of the piston 72. However, when the stop 75 is withdrawn from the path of the piston, the latter moves under the action of its springs, to allow an excess of fuel to be obtained. Moreover, when the piston is in this position, a portion of its end surface is shielded from the pressure which is derived from the first valve means, and the effect of this is that the pressure must build up an appreciable amount before the piston 72 will be moved. However, once movement of the piston has occurred, then the full face of the piston is exposed to this pressure. The practical effect of this is that the engine will be supplied with excess fuel until it has reached a predetermined speed whereafter the supply of excess fuel will cease, and even though the engine speed may drop and the manually operable stop be held out of contact with the piston, excess fuel will not be supplied to the engine.

Moreover, the piston 72 can be utilised to ensure that the delivery of fuel is retarded for starting purposes. If this feature is required, it would of course be provided as an alternative to the effect produced by the valve 66. The piston 72 for the purpose of providing retarding of the delivery of fuel for starting purposes, is utilised as a stop valve in the passage 61 which connects the outlet 27 of the feed pump with the groove on the valve element 58. For this purpose, the piston 72 is provided with a circumferential groove 76, and in normal circumstances, the groove 76 registers with a pair of ports respectively connected to the outlet of the feed pump and the passage 61. However, when the manually operable stop member 75 is released, the groove 76 moves out of register with the aforesaid ports so that no fuel under pressure is available for effecting movement of the piston 53. In these circumstances, the piston 53 will be moved to the fully retarded position by the reaction of the rollers with the cam lobes. The same effect may be obtained by providing the stop valve constituted by the piston 72, the groove 76 and the ports, in series with passage 59 so that the speed signal is witheld from the element 58 until the stop valve has been opened.

Figure 4:
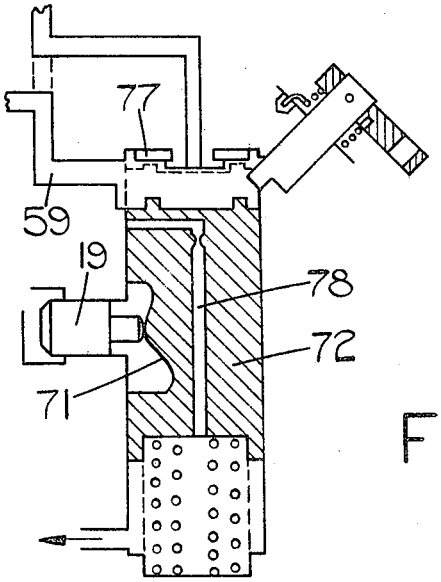
FIG. 4 shows an alternative arrangement to another portion of the apparatus seen in FIG. 2.

An alternative arrangement for controlling the application of fuel pressure to the valve element 58 is seen in FIG. 4. In this arrangement the piston 72 is not provided with a circumferential groove. Instead the passage 59 through which the fuel pressure is applied to the valve element 58 is taken from the end of the cylinder containing the piston 72 remote from the springs 73 and at a position outwardly of the resilient member 77 which acts to shield a portion of the surface of the piston. Thus when the piston is engaged with the resilient member, the application of fuel pressure to the valve element 58 is prevented. Moreover, it is arranged that the pressure at the end of the valve element 58 is kept at a low pressure until the piston 72 moves by means of a restricted passage 78 in the piston 72 and which is in communication with the passage 59 when the piston is is contact with the resilient member 77. The other end of the passage 78 communicates with a drain and when the piston 72 is moved by the fuel pressure, the passage 78 is moved out by communication with the passage 59.

I claim:

1. A liquid fuel injection pumping apparatus for supplying fuel to an internal combustion engine, comprising: an injection pump adapted to be driven in timed relationship with an internal combustion engine and having a cam, a feed pump for supplying fuel under pressure, a body, a movable throttle member located within said body, said throttle member and body defining an adjustable orifice through which fuel is adapted to flow for supply to said injection pump, fluid pressure operable means coupled to said cam whereby movement of said fluid operable means adjusts the timing of delivery of fuel by said injection pump; a first valve means operable to provide a first pressure which varies as the square of the speed at which said apparatus is driven, said first pressure being applied to said fluid pressure operable means whereby the timing of delivery of fuel is responsive to the speed at which the apparatus is driven, second valve means for providing a second pressure which varies in accordance with the law $RN^2$ where R is a constant and N the speed at which the apparatus is driven, fuel at said second pressure being supplied to the injection pump through said adjustable orifice, a third valve for providing a third pressure having a substantially constant value, and a further adjustable orifice defined by said throttle member and body for deriving control pressure from said third pressure, a piston adapted to be subjected to said control pressure, and resilient means, said piston acting to control the force exerted on said fluid pressure operable means by said resilient means acting in opposition to said first pressure.

2. An apparatus as claimed in claim 1 in which said throttle member comprises an axially movable member, and the apparatus includes a centrifugal weight mechanism acting to move the throttle member in an axial direction such as to reduce the amount of fuel supplied to the engine, a governor spring acting to oppose the axial movement of the member by said mechanism, said first valve means being defined by a bore extending to one end of said throttle member, a restrictor through which the bore is in communication with a supply of fuel, and the first valve means also including a movable closure member biased to close the end of the bore, said closure member being subjected to the force exerted by said weight mechanism whereby the pressure of fuel within the bore varies in accordance with the square of the speed.

3. An apparatus as claimed in claim 2 in which said supply of fuel is obtained from the outlet of the feed pump, the pressure of said supply being determined by the second valve means.

4. An apparatus as claimed in claim 2 in which said first mentioned adjustable orifice is defined by a port in said body and a circumferential groove on said throttle member, the pressure of fuel supplied to said groove being controlled by said second valve means, said restrictor communicating with said circumferential groove.

5. An apparatus as claimed in claim 4 in which said further adjustable orifice is defined by a second circumferential groove on said throttle member and a second port in the body.

6. An apparatus as claimed in claim 5 in which the pressure applied to said second port is controlled by said third valve means and said second circumferential groove is connected by a passage to a cylinder containing said piston the apparatus also including a restricted bleed passage extending from said passage, whereby the control pressure applied to said piston depends upon the axial setting of the throttle member.

7. An apparatus as claimed in claim 6 including a restrictor in said passage and a speed responsive valve operable at low speeds to place said cylinder in communication with a drain whereby the piston is not subject to the control pressure.

8. An apparatus as claimed in claim 1 in which said fluid pressure operable means comprises a valve element movable to control the application of fluid under pressure to a timing piston the movement of which determines the timing of delivery of fuel by the injection pump.

9. An apparatus as claimed in claim 8 including valve means operable when it is required to start the associated engine to prevent the application of said first pressure to said valve element, whereby the timing of delivery of fuel is retarded during starting of the engine.

10. An apparatus as claimed in claim 9 in which said valve means comprises a control piston subject to said first pressure and movable by the pressure against the action of resilient means.

11. An apparatus as claimed in claim 10 in which said control piston defines a contoured stop surface which determines the extent of movement of a shuttle, said shuttle acting to determine the maximum amount of fuel which can be delivered by the apparatus.

12. An apparatus as claimed in claim 11 including a manually operable latch which can be released to allow said control piston to move to a starting piston under the action of the resilient means, said control piston when in said starting position acting to cause prevention of the application of said pressures.

13. An apparatus as claimed in claim 8 including valve means operable when it is required to start the associated engine, to prevent the application of fluid pressure to said timing piston.

14. An apparatus as claimed in claim 1 including a speed responsive valve operable at low speeds to prevent the application of the control pressure to said piston.

15. An apparatus as claimed in claim 1 including a further valve operable when the associated engine is being started, to ensure that the timing of delivery of fuel to the engine is retarded.

* * * * *